US006954188B2

(12) United States Patent
Seo et al.

(10) Patent No.: US 6,954,188 B2
(45) Date of Patent: Oct. 11, 2005

(54) PLASMA DISPLAY PANEL DRIVING METHOD

(75) Inventors: Jeong-Hyun Seo, Seoul (KR); Joo-Yul Lee, Ahsan (KR); Tae-Hyun Kim, Cheonan (KR); Hee-Hwan Kim, Cheonan (KR); Min-Sun Yoo, Cheonan (KR)

(73) Assignee: Samsung SDI Co., Ltd., Suwon (KR)

( * ) Notice: Subject to any disclaimer, the term of this patent is extended or adjusted under 35 U.S.C. 154(b) by 35 days.

(21) Appl. No.: 10/200,140

(22) Filed: Jul. 23, 2002

(65) Prior Publication Data

US 2003/0156082 A1 Aug. 21, 2003

Related U.S. Application Data

(60) Provisional application No. 60/356,735, filed on Feb. 15, 2002.

(51) Int. Cl.[7] ..... G09G 3/28

(52) U.S. Cl. ..... 345/66; 345/67; 345/68; 315/169.1; 315/169.3; 315/169.4

(58) Field of Search ..... 345/60–63, 66–68, 345/37; 315/169.1, 169.4

(56) References Cited

U.S. PATENT DOCUMENTS 6,249,087 B1 * 6/2001 Takayama et al. ..... 315/169.1
6,483,250 B1 * 11/2002 Hashimoto et al. ..... 315/169.4
6,603,447 B1 * 8/2003 Ito et al. ..... 345/60
6,621,229 B2 * 9/2003 Kanazawa et al. ..... 315/169.3
6,653,994 B2 * 11/2003 Takeda et al. ..... 345/60
2002/0097003 A1 * 7/2002 Takamori et al. ..... 315/169.4
2002/0190930 A1 * 12/2002 Shiizaki et al. ..... 345/63

FOREIGN PATENT DOCUMENTS

KR 2003-0079485 10/2003 ..... G09G/3/28

* cited by examiner

*Primary Examiner*—Henry N. Tran
(74) *Attorney, Agent, or Firm*—McGuireWoods LLP

(57) ABSTRACT

A PDP driving method that reduces the reset voltage of the PDP driving waveforms to make it possible to use low-voltage elements and to achieve high contrasts is disclosed. Since conventional PDP waveforms require very high reset voltages, it causes a problem of intense background light emissions, low contrasts, use of high-voltage components, and increased circuit costs. According to the driving waveforms of the present invention, relative voltage differences between the address electrode and the X electrode and between the X electrode and the Y electrode are considered to design waveforms of low reset voltages, thereby providing high contrasts and low-cost circuit.

47 Claims, 5 Drawing Sheets

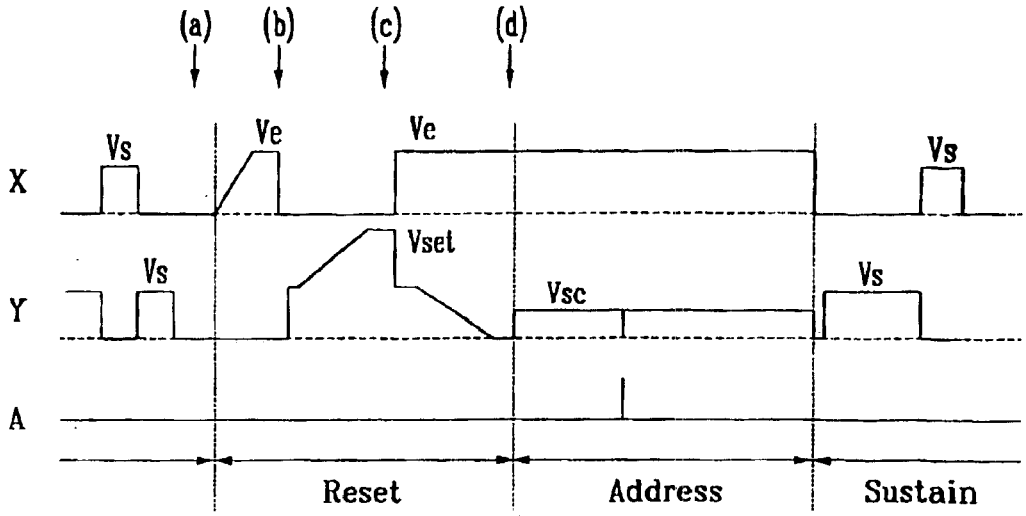
FIG.4A(Prior Art)
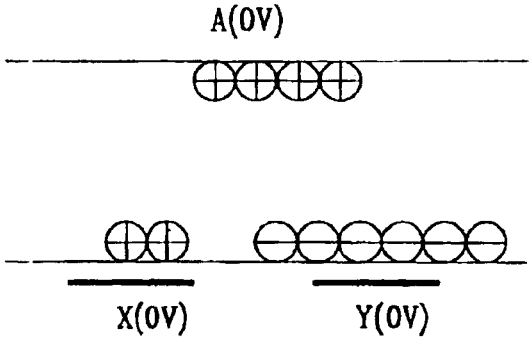
FIG.4B(Prior Art)
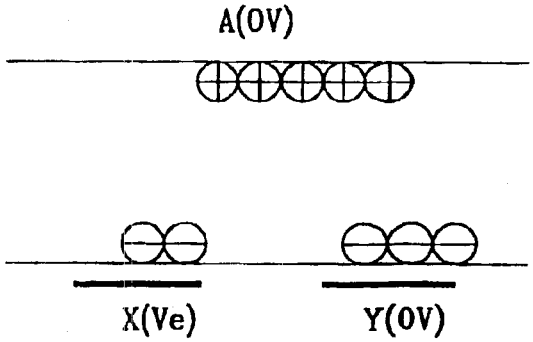
FIG.4C(Prior Art)
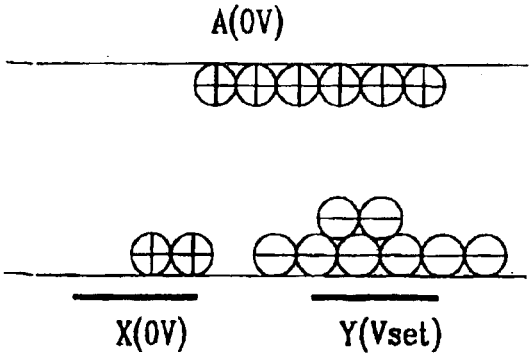
FIG.4D(Prior Art)
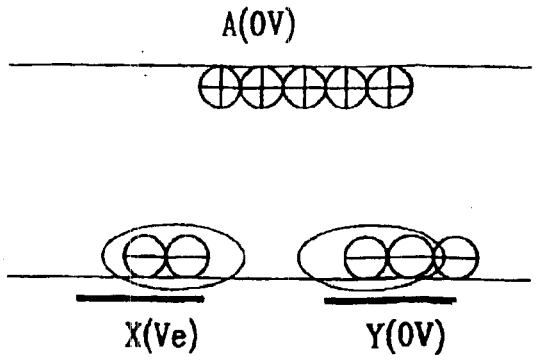

PLASMA DISPLAY PANEL DRIVING METHOD

CROSS REFERENCE TO RELATED APPLICATION

This application is based on U.S. Provisional Application No. 60/356,735 filed on Feb. 15, 2002, of which content is hereby incorporated by reference and the benefit of which filing date is hereby claimed.

BACKGROUND OF THE INVENTION (a) Field of the Invention

The present invention relates to a PDP (plasma display panel) driving method. More specifically, the present invention relates to a low voltage resetting PDP driving method.

(b) Description of the Related Art

Recently, flat displays such as LCDs (liquid crystal displays), FEDs (field emission displays), and PDPs have been widely developed. Among them, PDPs have higher luminance and wider viewing angles compared to other flat displays. Hence, PDPs have come into the spotlight as substitutes for conventional CRTs (cathode ray tubes) having screen sizes bigger than 40 inches.

The PDP is a flat display for using plasma generated via a gas discharge process to display characters or images. Tens of millions of pixels are provided thereon in a matrix format, depending on its size. PDPs are categorized into DC PDPs and AC PDPs, depending on driving voltages and discharge cell structures.

Since the DC PDPs have electrodes exposed in the discharge space, they allow the current to flow in the discharge space while the voltage is supplied, and therefore, they have a problem of requiring resistors for current restriction. On the other hand, the AC PDPs have electrodes covered by a dielectric layer. This structure naturally forms capacitance that restricts the current, and protects the electrodes from ion shocks in the case of discharging. Accordingly, they have a longer lifespan than the DC PDPs.

FIG. 1 shows a perspective view of an AC PDP.

As shown, a scan electrode 4 and a sustain electrode 5, disposed over a dielectric layer 2 and a protection film 3, are provided in parallel and form a pair with each other under a first glass substrate 1. A plurality of address electrodes 8 covered with an insulation layer 7 are installed on a second glass substrate 6. Barrier ribs 9 are formed in parallel with the address electrodes 8, on the insulation layer 7 between the address electrodes 8, and phosphor 10 is formed on the surface of the insulation layer 7 between the barrier ribs 9. The first glass substrate 1 and the second glass substrate 6 having a discharge space 11 between them are provided facing each other so that the scan electrode 4 and the sustain electrode 5 may respectively cross the address electrode 8. The address electrode 8 and a discharge space 11 formed at a crossing part of the scan electrode 4 and the sustain electrode 5 form a discharge cell 12.

FIG. 2 shows a PDP electrode arrangement diagram.

As shown, the PDP electrode has an m×n matrix configuration, and in detail, it has address electrodes A1 to Am in the column direction, and scan electrodes Y1 to Yn and sustain electrodes X1 to Xn in the row direction, alternately. Hereinafter, the scan electrode will be referred to as a Y electrode, and the sustain electrode as an X electrode. The discharge cell 12 shown in FIG. 2 corresponds to the discharge cell 12 shown in FIG. 1.

FIG. 3 shows prior art PDP driving waveforms, and FIGS. 4A, 4B, 4C and 4D show wall charge distributions at each period when using a conventional driving method. That is, FIGS. 4A, 4B, 4C and 4D respectively show the charge distributions corresponding to parts (a), (b), (c) and (d) of the driving waveforms shown in FIG. 3.

As shown in FIG. 3, each subfield includes a reset period, an address period, and a sustain period according to the conventional PDP driving method.

In the reset period, the panel erases wall charges formed in the previous sustain discharge period, and sets a new wall charge state in order to make sure that the following address period performs appropriately.

In the address period, the panel selects the cells that will be turned on and accumulates wall charges of the cells to be turned on. In the sustain period, the panel keeps discharging at the addressed cells in order to display images.

A conventional operation during the reset period will be further described with reference to FIGS. 3 and 4A through 4D. As shown in FIG. 3, the conventional reset period includes an erase period, a Y ramp rising period, and a Y ramp falling period.

(1) Erase Period

When a final sustain discharge is finished, positive charges are accumulated to the X electrode, and negative charges to the Y electrode, as shown in FIG. 4A. The address voltage sustains 0 volts during the sustain period, but since it attempts to internally sustain an intermediate voltage of the sustain discharge, a great volume of positive charges are accumulated to the address electrode.

When the sustain discharge is finished, an erase ramp voltage that gradually rises from 0(V) to+Ve (V) is supplied to the X electrode, and the wall charges formed to the X and Y electrodes are then gradually erased to enter the state shown in FIG. 4B.

(2) Y Ramp Rising Period

The address electrode and the X electrode are sustained at 0 volt during this period, and a ramp voltage that gradually rises from the voltage Vs to the voltage Vset is supplied to the Y electrode. Vs is lower than a firing voltage of the X electrode and Vset is higher than the firing voltage of the X electrode. While the ramp voltage is rising, a first weak reset discharge is generated to all discharge cells from the Y electrode to the address electrode and the X electrode. As shown in FIG. 4C, the results are accumulation of negative wall charges at the Y electrode, and positive wall charges at the address electrode and the X electrode concurrently.

(3) Y Ramp Falling Period

While the X electrode sustains a constant voltage Ve, a ramp voltage is supplied to the Y electrode. The ramp voltage gradually falls to 0 volt from the voltage Vs that is lower than the firing voltage of the X electrode. While the ramp voltage is falling, a second weak reset discharge is generated to all discharge cells. As a result, as shown in FIG. 4D, the negative wall charges at the Y electrode are reduced, and the polarity of the X electrode is inverted to store weak negative charges. Also, the positive wall charges at the address electrode are adjusted to be suitable for an address operation. If the panel is appropriately reset, the discharge cell sustains a voltage difference corresponding to the firing voltage Vf, as expressed in Equation 1.

$$Vf,xy=Ve+Vw,xy$$

$$Vf,ay=Vw,ay \qquad \text{Equation 1}$$

where Vf,xy represents the firing voltage between the X and Y electrodes; Vf,ay indicates the firing voltage between the address electrode and Y electrode; Vw,xy shows the voltage generated by the wall charges accumulated to the X and Y electrodes; Vw,ay denotes the voltage generated by the wall charges accumulated to the address electrode and the Y electrode, and Ve represents the externally supplied voltage between the X and Y electrodes.

As expressed in Equation 1, since the external voltage Ve (approximately 200 volts) is supplied between the X and Y electrodes, some wall charges sustain the firing voltage. However, no external voltage is supplied between the address electrode and the Y electrode. Therefore, the firing voltage is sustained only through the wall charges.

Referring to FIG. 4D, the charges marked with circles on the X and Y electrodes are not useful in sustaining the voltage difference between the X and Y electrodes. However, the charges are generated because many positive charges in the address electrode and negative charges in the Y electrode are stored respectively. This creates a voltage difference of as much as required for the firing voltage by using the wall charges between the address electrode and the Y electrode. According to the conventional method, a high voltage of Vset (about 380 volts) is required to perform sufficient discharging and to form the wall charges.

Therefore, in the conventional driving method, the voltage Vset higher than 380 volts has to be supplied so as to obtain a sufficient voltage margin, in order to reset the Y electrode. This requires components that can withstand higher voltage. Also, the conventional method generates high intensity of background light emission, rendering it difficult to achieve high contrast.

SUMMARY OF THE INVENTION

It is an object of the present invention to provide a PDP driver and a PDP driving method that can reduce a reset voltage to use low-voltage elements and to achieve high contrast.

In order to achieve the object, the driving waveforms are generated in consideration of relative voltage differences between the address electrode and the X electrode and between the X electrode and the Y electrode, which will be subsequently described.

According to the conventional driving methods, as previously described, the wall charges marked with circles in FIG. 4D do not contribute to generation of voltage differences between the X electrode and the Y electrode. That is, they do not influence the voltage difference between the X electrode and the Y electrode even when four electrons are not provided to the X electrode and the Y electrode.

Thus, the present invention removes unnecessary negative charges stored in the X electrode and the Y electrode, and generates an internal voltage difference to provide a firing voltage between the address electrode and the Y electrode. Accordingly, the reset voltage may be lowered since less charge is required.

To achieve this, the present invention provides a voltage difference between the address electrode and the Y electrode when the reset stage is finished in the prior waveforms. That is, the voltage at the Y electrode is set to be lower than the voltage (0 volts) at the address electrode, and FIG. 5 shows a wall charge concept in this case.

As shown, the charges are ideally not stored in the X electrode after the reset operation, and less wall charges compared to the conventional method are formed at the address electrode and the Y electrode.

In this instance, the firing voltage formed in the discharge cell after reset operation is expressed in Equation 2.

$$Vf,xy=Ve+Vw,xy$$

$$Vf,ay=V'w,ay+Vn \qquad \text{Equation 2}$$

where Vf,xy represents the firing voltage between the X electrode and the Y electrode; Vf,ay indicates the firing voltage between the address electrode and the Y electrode; Vw,xy denotes the voltage generated by the wall charges accumulated at the X electrode and the Y electrode; V'w,ay represents the voltage caused by the wall charges accumulated at the address electrode and the Y electrode; Ve indicates the externally-received voltage between the X and Y electrodes; and Vn denotes the externally-received voltage between the address electrode and the Y electrode.

As expressed in Equation 2, since the present invention sustains the voltage difference of Vn between the address electrode and the Y electrode when terminating the reset operation, it can reduce the voltage V'w,ay caused by the wall charges accumulated at the address electrode and the Y electrode. Therefore, since less wall charges compared to the prior art can be stored in the address electrode, a lower reset voltage Vset can be used for driving operation.

BRIEF DESCRIPTION OF THE DRAWINGS

The accompanying drawings, which are incorporated in and constitute a part of the specification, illustrate an embodiment of the invention, and, together with the description, serve to explain the principles of the invention.

FIG. 3 shows a conventional PDP driving waveform diagram.

FIGS. 4A, 4B, 4C and 4D show wall charge distribution diagrams for respective steps of the driving waveforms shown in FIG. 3.

DETAILED DESCRIPTION OF THE PREFERRED EMBODIMENTS

In the following detailed description, only the preferred embodiments of the invention have been shown and described, simply by way of illustrating the best modes contemplated by the inventor(s) of carrying out the invention. As will be realized, the invention is capable of modification in various obvious respects, all without departing from the invention. Accordingly, the drawings and description are to be regarded as illustrative in nature, and not restrictive.

Figure 11:
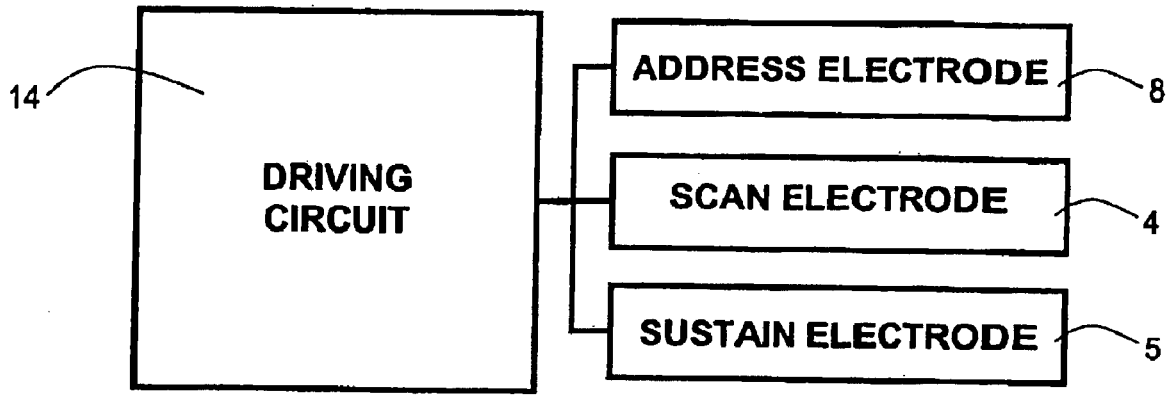
FIG. 11 shows a schematic diagram illustrating the general relationship between a driving circuit and the address, scan, and sustain electrodes.

FIG. 11 shows a schematic diagram illustrating the general relationship and connections between a driving circuit 14, the scan (Y) electrode 4, the sustain (X) electrode 5, and the address (A) electrode 8 in embodiments of the invention.

Figure 1:
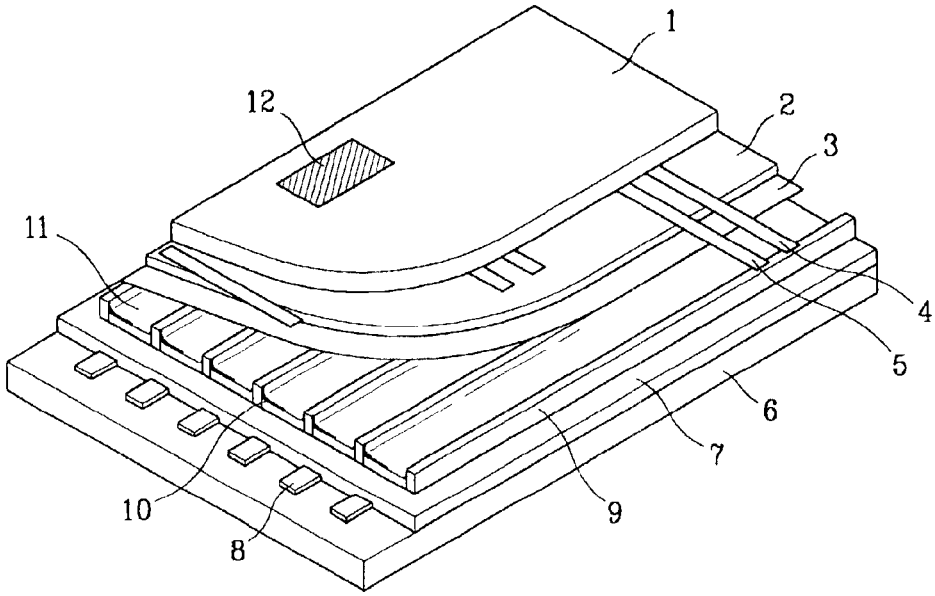
FIG.1(Prior Art)
FIG. 1 shows a perspective view of an AC PDP.
Figure 2:
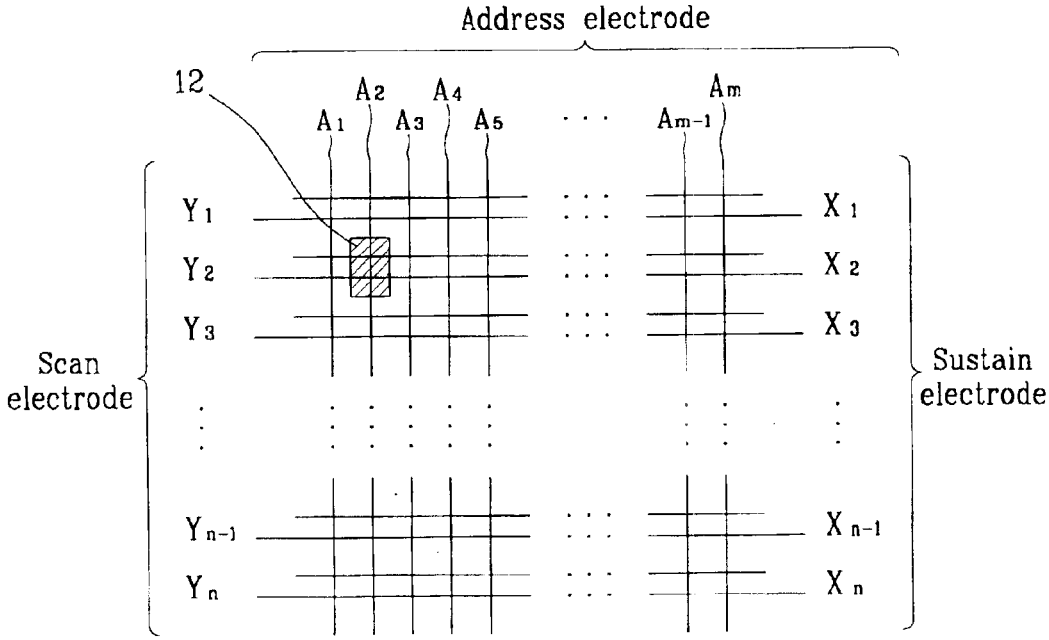
FIG.2(Prior Art)
FIG. 2 shows a PDP electrode arrangement diagram.
Figure 5:
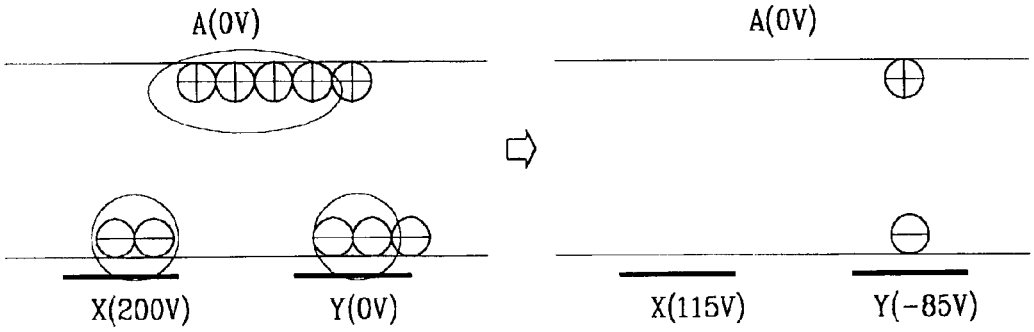
FIG. 5 shows a wall charge distribution diagram of driving waveforms according to a preferred embodiment of the present invention.
Figure 6:
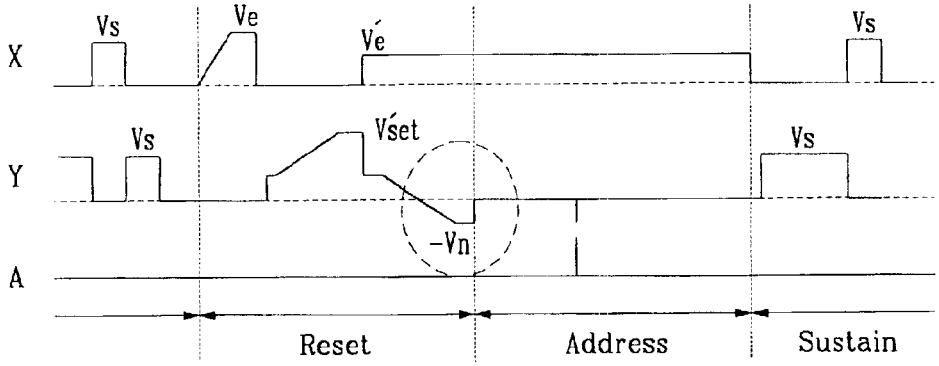
FIG. 6 shows PDP driving waveforms according to a first preferred embodiment of the present invention.

FIG. 6 shows PDP driving voltage waveforms according to a first preferred embodiment of the present invention.

As shown, according to the first preferred embodiment of the present invention, the voltage at the Y electrode is lowered to less than the address voltage (ground voltage) in the falling ramp period. Accordingly, the difference (i.e., V'e+Vn) of the externally-received voltage at the X electrode and the Y electrode is sustained to be similar to the conventional voltage difference Ve. This provides the externally-received voltage difference (i.e., Vn) between the address electrode and the Y electrode and compensates the insufficient wall charges between the address electrode and the Y electrode.

The driving waveforms according to the first preferred embodiment of the present invention as shown in FIG. 6, lowers the voltage during the falling ramp period below the address voltage. It can lower the voltage V'set marginally as described above, but cannot lower sufficiently. It is because some cells are turned on and other cells are not turned on at a lower voltage v'set depending on whether the phosphor used in the cell is for the color of red, green or blue. This renders the background beams spatially non-uniform. It is necessary to sustain the voltage V'set to be at a predetermined level that can turn on the red, green, and blue cells, constraining the lower limit of the voltage V'set.

Figure 7:
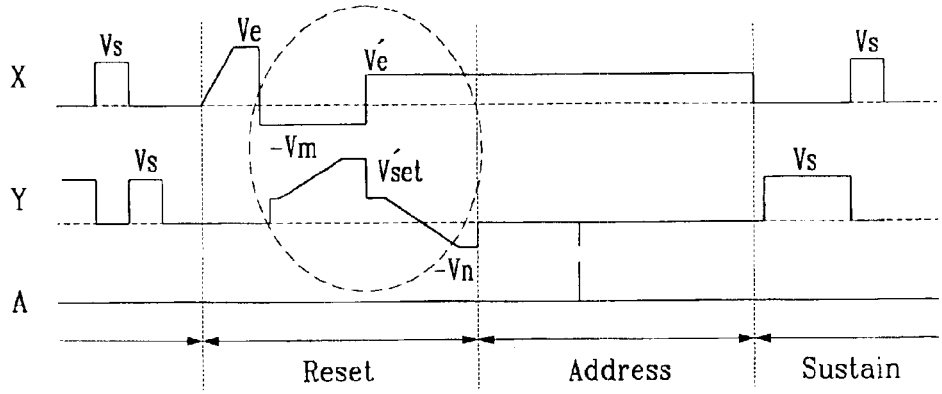
FIG. 7 shows PDP driving waveforms according to a second preferred embodiment of the present invention.

The driving waveforms according to a second preferred embodiment of the present invention shown in FIG. 7 are provided so as to solve the problems of the driving waveforms according to the first preferred embodiment of the present invention.

It is difficult to achieve a stable background discharge in the first preferred embodiment because the discharge voltage varies depending on the characteristics of the phosphors.

The second preferred embodiment generates discharging between the X electrode and the Y electrode during the rising ramp period to solve the above-noted problem. As shown in FIG. 7, when the electric potential at the X electrode is reduced to the negative voltage −Vm with respect to the address voltage (0 volts), the voltage supplied between the X electrode and the Y electrode becomes V'set+Vm. This secures the background discharge. Hence, according to the second preferred embodiment of the present invention, the voltage V'set can be lowered by Vm when compared to the voltage V'set of the first preferred embodiment.

According to the second preferred embodiment of the present invention, the sustain-discharge voltage Vs and the ground voltage are alternately supplied to the X and Y electrodes during the sustain-discharge period. Any of the reset period voltage lower than the voltage variance range of the sustain-discharge period may drain currents from a sustain-discharge circuit to a reset circuit. Accordingly, a circuit that can prevent such flow is required, complicating the driving circuit.

Figure 8:
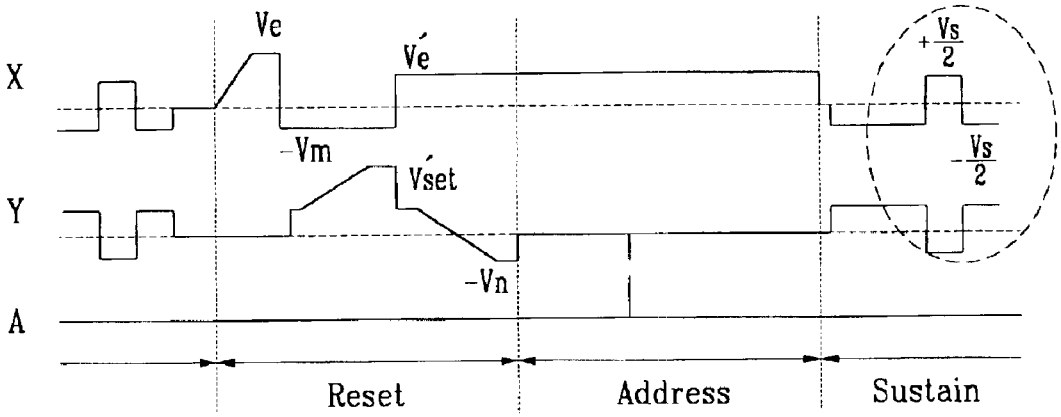
FIG. 8 shows PDP driving waveforms according to a third preferred embodiment of the present invention.

FIG. 8 shows PDP driving waveforms according to a third preferred embodiment of the present invention for solving the above-described problem.

The waveforms according to the third preferred embodiment are similar to those shown in FIG. 7. The main difference is that the voltage of ±Vs/2 is alternately supplied to the X electrode and the Y electrode during the sustain-discharge period. During the reset period, the magnitude of voltage −Vn of the Y falling ramp is set to be equal to or greater than the magnitude of −Vs/2, and the magnitude of the negative bias voltage −Vm at the X electrode is set to be equal to or greater than the magnitude of −Vs/2 so that they may not be lowered below the sustain-discharge voltage during the sustain-discharge period. This prevents the current from draining from the sustain-discharge circuit to the reset circuit. Therefore, no prevention circuit is necessary, simplifying the corresponding circuit.

In the third preferred embodiment, the voltage −Vn of the Y falling ramp period and the negative bias voltage −Vm of the X electrode during the Y rising ramp period can be set to be equal to −Vs/2. In this case, the circuit becomes simpler because the reset part and the sustain-discharge part can share the circuit for supplying the voltage −Vs/2.

According to the third preferred embodiment shown in FIG. 8, the voltage Ve of the waveforms of the erase rising ramp for the X electrode supplied after the final sustain-discharge is different from other voltages (e.g., V'e), requiring an additional power.

Figure 9:
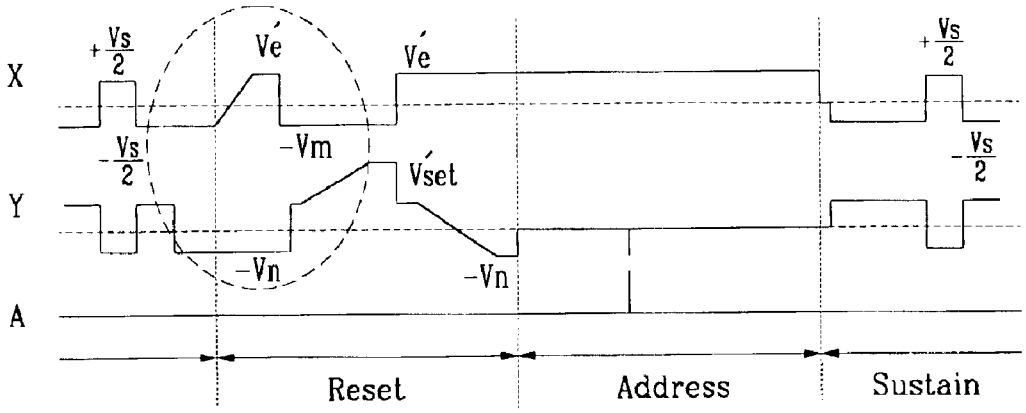
FIG. 9 shows PDP driving waveforms according to a fourth preferred embodiment of the present invention.

FIG. 9 shows a fourth preferred embodiment of the present invention to solve such a problem.

In the fourth preferred embodiment, the erase rising ramp voltage for the X electrode is lowered to V'e. The voltage of the Y electrode corresponding to the erase rising ramp of the X electrode is set to be matched with the negative bias voltage −Vm of the X electrode during the Y rising ramp period. The voltage Ve for the X erase ramp does not need to be additionally supplied through this circuit modification, rendering the circuit simpler.

Further, in order to make the circuit of the fourth preferred embodiment simpler, the voltages −Vn and −Vm can be set to match −Vs/2.

According to the fourth preferred embodiment shown in FIG. 9, when the voltage of the Y electrode is modified to −Vs/2 from Vs/2 after the final sustain-discharge, discharging may be easily generated between the address electrode and the Y electrode, rendering the discharging unstable. Since the voltage Vs/2 is supplied to the Y electrode at the final point of the sustain-discharge as shown in FIG. 4A according to the fourth preferred embodiment of the present invention, it may easily generate discharging. This problem can be solved by using narrow-width erase, which is an erase waveform of the X electrode, but it can also be solved by using the waveforms according to the fifth preferred embodiment of the present invention shown in FIG, 10.

According to the driving waveforms of the fifth preferred embodiment, a ramp voltage of the Y electrode gradually falls to −Vn from Vs/2 after the final sustain-discharge. The voltage is inverted to +Vs/2 from −Vs/2 and supplied to the X electrode. These voltage waveforms generate erase ramp waveforms, and such an erase ramp provides easy implementation and stable discharging.

Figure 10:
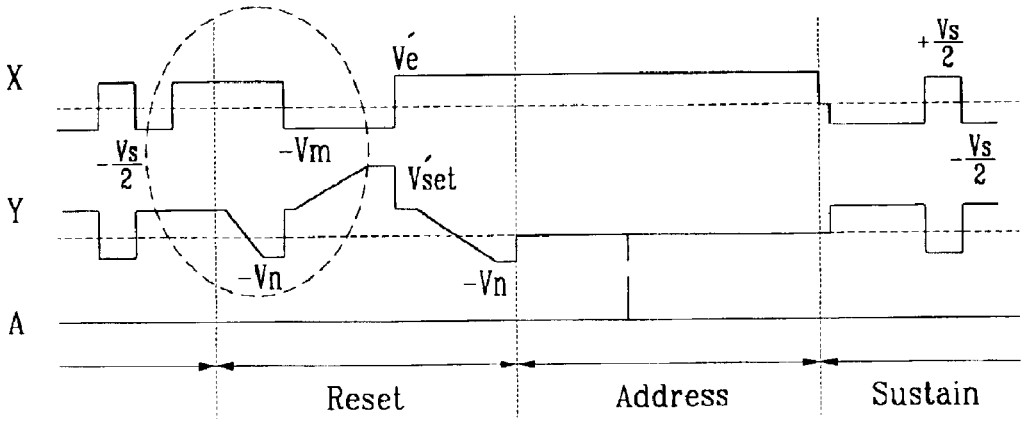
FIG. 10 shows PDP driving waveforms according to a fifth preferred embodiment of the present invention.

Table 1 shows the comparison of the conventional waveforms shown in FIG. 3 with those of the fifth preferred embodiment shown in FIG. 10.

TABLE 1

| | Conventional waveform | Waveform according to preferred embodiments |
|---|---|---|
| Vset (V'set) | 380 (V) | 230 (V) |
| Ve (V'e) | 190 (V) | 110 (V) |
| Background light emission | 0.964 (Cd/m$^2$) | 0.811 (Cd/m$^2$) |
| Contrast | 550:1 | 664:1 |

As shown in Table 1, the present embodiment lowers the driving voltages Vset and Ve for the reset operation than the conventional waveforms, enabling the use of low-voltage components. Also, use of the low reset voltage Vset reduces the background light emission, achieving high contrasts.

Although Table 1 presents comparisons of the preferred embodiment with the conventional waveforms on the basis of the driving waveforms shown in FIG. 10, the driving waveforms according to other preferred embodiments produce the same results as in Table 1.

According to the present invention, lower reset voltage of the PDP driving waveforms allows the use of low-voltage elements and reduces the PDP production costs.

Further, the lower reset voltage can reduce background light emission and increase the contrast.

While this invention has been described in connection with what is presently considered to be the most practical and preferred embodiment, it is to be understood that the invention is not limited to the disclosed embodiments, but, on the contrary, is intended to cover various modifications and equivalent arrangements included within the spirit and scope of the appended claims.

What we claim is:

1. A method for driving a plasma display panel (PDP), wherein the PDP includes a first electrode and a second electrode respectively formed in parallel on an upper substrate, an address electrode formed normal to the first electrode and the second electrode on a lower substrate, comprising steps of:

during a reset period, applying to the first electrode a first rising ramp voltage gradually increasing to a first voltage level, while keeping the second electrode at a second voltage level;

applying to the second electrode a second rising ramp voltage gradually increasing to a third voltage level, while keeping the first electrode at a fourth voltage level;

applying to the second electrode a falling ramp voltage gradually decreasing to a fifth voltage level, while applying to the first electrode a sixth voltage level; and keeping the address electrode at a ninth voltage level throughout the reset period, wherein the fifth voltage level has a negative polarity.

2. The method of claim 1, wherein the ninth voltage level is higher than the fifth voltage level.

3. The method of claim 1, wherein the sixth voltage level is lower than the first voltage level.

4. The method of claim 1, wherein the second voltage level is ground level.

5. The method of claim 4, wherein the fourth voltage level is ground level.

6. The method of claim 3, wherein voltage difference between the fifth voltage level and the sixth voltage level is within a range enough to cause a discharge between the second electrode and the address electrode.

7. The method of claim 1, wherein the fourth voltage level has a negative voltage level.

8. The method of claim 7, wherein the sixth voltage level is lower than the first voltage level.

9. The method of claim 7, wherein the second voltage level is ground level.

10. The method of claim 7, wherein voltage difference between the third voltage level and the fourth voltage level is within a range enough to cause discharge between the first electrode and the second electrode.

11. The method of claim 7, further comprising steps of:

during a sustain period, applying simultaneously to the first electrode a seventh voltage level and to the second electrode an eighth voltage level in a first subperiod;

applying simultaneously to the first electrode the eighth voltage level and to the second electrode the seventh voltage level in a following second subperiod, wherein the seventh voltage level and the eighth voltage level have same magnitude but opposite polarities.

12. The method of claim 11, wherein the first subperiod and the second subperiod are alternately repeated throughout the sustain period.

13. The method of claim 11, wherein difference between the seventh voltage and the eighth voltage is within a range that is minimally required for sustaining discharges between the first electrode and the second electrode.

14. The method of claim 13, wherein magnitude of the fifth voltage level is set to be equal to or greater than magnitude of the seventh voltage level.

15. The method of claim 14, wherein magnitude of the fourth voltage level is set to be equal to or greater than the magnitude of the seventh voltage level.

16. The method of claim 11, wherein the first rising ramp voltage gradually increases from the seventh voltage level to the sixth voltage level, and wherein the second voltage level is same as the fifth voltage level.

17. The method of claim 16, wherein magnitude of the fifth voltage level is set to be equal to or greater than magnitude of the seventh voltage level.

18. The method of claim 17, wherein voltage difference between the first voltage level and the second voltage level is within a range that can cause a discharge between the first electrode and the second electrode.

19. The method of claim 18, wherein magnitude of the fifth voltage level is set to be equal to or greater than the magnitude of the seventh voltage level.

20. The method of claim 19, wherein magnitude of the fourth voltage level is set to be equal to or greater than the magnitude of the seventh voltage level.

21. A method for driving a plasma display panel (PDP), wherein the PDP includes a first electrode and a second electrode respectively formed in parallel on an upper substrate, an address electrode formed normal to the first electrode and the second electrode on a lower substrate, comprising steps of:

during a reset period, applying to the second electrode a first falling ramp voltage gradually decreasing from a first voltage level to a second voltage level, while keeping the first electrode at the first voltage level;

applying to the second electrode a first rising ramp voltage gradually increasing to a third voltage level, while keeping the first electrode at a fourth voltage level;

applying to the second electrode a second falling ramp voltage gradually decreasing to a fifth voltage level, while applying to the first electrode a sixth voltage level; and keeping the address electrode at a seventh voltage level throughout the reset period, wherein the fifth voltage level has a negative polarity.

22. The method of claim 21, further comprising steps of:

during a sustain period, applying simultaneously to the first electrode an eighth voltage level and to the second electrode the first voltage level in a first subperiod;

applying simultaneously to the first electrode the first voltage level and to the second electrode the eighth voltage level in a following second subperiod, wherein the first voltage level and the eighth voltage level have same magnitude but opposite polarities.

23. The method of claim 22, wherein the seventh voltage level is higher than the fifth voltage level.

24. The method of claim 22, wherein the second voltage level is the same as the fifth voltage level.

25. The method of claim 22, wherein voltage difference between the first voltage level and the second voltage level is within a range that can cause a discharge between the first electrode and the second electrode.

26. The method of claim 25, wherein magnitude of the fifth voltage level is set to be equal to or greater than the magnitude of the eighth voltage level.

27. The method of claim 26, wherein magnitude of the fourth voltage level is set to be equal to or greater than the magnitude of the eighth voltage level.

28. A plasma display panel (PDP), comprising:

an upper substrate;

a first electrode and a second electrode formed in parallel on the upper substrate;

a lower substrate;

an address electrode; and a driving circuit that sends a driving signal to the first electrode, the second electrode and the address electrode during a reset period, an address period and a sustain period, wherein, during the reset period, the driving circuit, applies to the first electrode a first rising ramp voltage gradually increasing to a first voltage level, while keeping the second electrode at a second voltage level;

applies to the second electrode a second rising ramp voltage gradually increasing to a third voltage level, while keeping the first electrode at a fourth voltage level;

applies to the second electrode a failing ramp voltage gradually decreasing to a fifth voltage level, while applying to the first electrode a sixth voltage level; and keeping the address electrode at a ninth voltage level throughout the reset period, wherein the fifth voltage level has a negative polarity.

29. The plasma display panel of claim 28, wherein the ninth voltage level is higher than the fifth voltage level.

30. The plasma display panel of claim 28, wherein the sixth voltage level is lower than the first voltage level.

31. The plasma display panel of claim 28, wherein the second voltage level is ground level.

32. The plasma display panel of claim 31, wherein the fourth voltage level is ground level.

33. The plasma display panel of claim 30, wherein voltage difference between the fifth voltage level and the sixth voltage level is within a range enough to cause a discharge between the second electrode and the address electrode.

34. The plasma display panel of claim 28, wherein the fourth voltage level has a negative voltage level.

35. The plasma display panel of claim 34, wherein the sixth voltage level is lower than the first voltage level.

36. The plasma display panel of claim 34, wherein the second voltage level is ground level.

37. The plasma display panel of claim 34, wherein voltage difference between the third voltage level and the fourth voltage level is within a range enough to cause discharge between the first electrode and the second electrode.

38. The plasma display panel of claim 34, wherein, during a sustain period, the driving circuit further applies simultaneously to the first electrode a seventh voltage level and to the second electrode an eighth voltage level in a first subperiod;

applies simultaneously to the first electrode the eighth voltage level and to the second electrode the seventh voltage level in a following second subperiod, wherein the seventh voltage level and the eighth voltage level have same magnitude but opposite polarities.

39. The plasma display panel of claim 38, wherein the first subperiod and the second subperiod are alternately repeated throughout the sustain period.

40. The plasma display panel of claim 38, wherein difference between the seventh voltage and the eighth voltage is within a range that is minimally required for sustaining discharges between the first electrode and the second electrode.

41. The plasma display panel of claim 40, wherein magnitude of the fifth voltage level is set to be equal to or greater than magnitude of the seventh voltage level.

42. The plasma display panel of claim 41, wherein magnitude of the fourth voltage level is set to be equal to or greater than the magnitude of the seventh voltage level.

43. The plasma display panel of claim 38, wherein the first rising ramp voltage gradually increases from the seventh voltage level to the sixth voltage level, and wherein the second voltage level is same as the fifth voltage level.

44. The plasma display panel of claim 43, wherein magnitude of the fifth voltage level is set to be equal to or greater than magnitude of the seventh voltage level.

45. The plasma display panel of claim 44, wherein voltage difference between the first voltage level and the second voltage level is within a range that can cause a discharge between the first electrode and the second electrode.

46. The plasma display panel of claim 45, wherein magnitude of the fifth voltage level is set to be equal to or greater than the magnitude of the seventh voltage level.

47. The plasma display panel of claim 46, wherein magnitude of the fourth voltage level is set to be equal to or greater than the magnitude of the seventh voltage level.

* * * * *